US005819743A

United States Patent [19]

McMillin et al.

[11] Patent Number: 5,819,743

[45] Date of Patent: Oct. 13, 1998

[54] EXTREMITY PILLOW

[76] Inventors: James A. McMillin; Diane McMillin, both of 850 N. Dewitt Pl., Apt #13A, Chicago, Ill. 60611

[21] Appl. No.: 916,504

[22] Filed: Aug. 22, 1997

[51] Int. Cl.[6] ..... A61G 15/00

[52] U.S. Cl. ..... 128/845; 128/846; 5/636

[58] Field of Search ..... 128/845, 846, 128/882; 5/630, 636, 637, 638

[56] References Cited

U.S. PATENT DOCUMENTS

| | | | |
|---|---|---|---|
| 3,829,917 | 8/1974 | De Laittre | 5/636 |
| 4,210,134 | 7/1980 | Okazaki | 5/636 |
| 4,218,792 | 8/1980 | Kogan | 5/636 |
| 4,320,543 | 3/1982 | Dixon | 5/636 |
| 5,123,132 | 6/1992 | Dixon | 5/636 |
| 5,652,981 | 8/1997 | Singer-Leyton | 5/638 |

*Primary Examiner*—Michael A. Brown

[57] ABSTRACT

An extremity pillow is provided including a block of foam having a bottom face, a two pairs of side faces, and a top face. Further provided is a trough formed in the top face of the block of foam about an axis which resides perpendicular with respect to a central extent of one of the pairs of side faces. Next provided is a plurality of ellipsoidal protrusions formed in the top face of the block of foam.

5 Claims, 2 Drawing Sheets

EXTREMITY PILLOW

BACKGROUND OF THE INVENTION

1. Field of the Invention

The present invention relates to an extremity pillow and more particularly pertains to precluding the inadvertent removal of an extremity of a user therefrom.

2. Description of the Prior Art

The use of extremity supports is known in the prior art. More specifically, extremity supports heretofore devised and utilized for the purpose of supporting arms and legs are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 4,270,235; U.S. Pat. No. 5,216,771; U.S. Pat. Des. 354,356; U.S. Pat. No. 5,289,828; U.S. Pat. No. 4,135,504; and U.S. Pat. No. 247,311.

In this respect, the extremity pillow according to the present invention substantially departs from the conventional concepts and designs of the prior art, and in so doing provides an apparatus primarily developed for the purpose of precluding the inadvertent removal of an extremity of a user therefrom.

Therefore, it can be appreciated that there exists a continuing need for a new and improved extremity pillow which can be used for precluding the inadvertent removal of an extremity of a user therefrom. In this regard, the present invention substantially fulfills this need.

SUMMARY OF THE INVENTION

In view of the foregoing disadvantages inherent in the known types of extremity supports now present in the prior art, the present invention provides an improved extremity pillow. As such, the general purpose of the present invention, which will be described subsequently in greater detail, is to provide a new and improved extremity pillow which has all the advantages of the prior art and none of the disadvantages.

To attain this, the present invention essentially comprises a block of urethane foam. Such block has a horizontally orientated bottom face, a pair of long vertically oriented side faces, a pair of short vertically oriented side faces, and a top face. Note FIGS. 1 & 3. The bottom face and long vertically oriented side faces are each planar and have a rectangular configuration. As best shown in FIGS. 3 & 4, a curvilinear trough is formed in the top face of the block of foam. Such trough is positioned about an axis which resides perpendicular with respect to a central extent of the short vertically oriented side faces. Next provided is a plurality of ellipsoidal protrusions formed in the top face. Such protrusions defines a plurality of rows and columns. Such matrix of rows and columns of protrusions are configured such that a first focus of the protrusions of each column are aligned with each other and further aligned with those of a first adjacent column. Each protrusion of a common column further has a second focus aligned with that of the other protrusions of the column. Further, such second foci are aligned with those of a second adjacent column. It should be noted that the foci of the protrusions of each row define a line which is parallel with the axis of the trough.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved extremity pillow which has all the advantages of the prior art extremity supports and none of the disadvantages.

It is another object of the present invention to provide a new and improved extremity pillow which may be easily and efficiently manufactured and marketed.

It is a further object of the present invention to provide a new and improved extremity pillow which is of a durable and reliable construction.

An even further object of the present invention is to provide a new and improved extremity pillow which is susceptible of a low cost of manufacture with regard to both materials and labor, and which accordingly is then susceptible of low prices of sale to the consuming public, thereby making such extremity pillow economically available to the buying public.

Still yet another object of the present invention is to provide a new and improved extremity pillow which provides in the apparatuses and methods of the prior art some of the advantages thereof, while simultaneously overcoming some of the disadvantages normally associated therewith.

Still another object of the present invention is to preclude the inadvertent removal of an extremity of a user therefrom.

Lastly, it is an object of the present invention to provide a new and improved a block of foam having a bottom face, a two pairs of side faces, and a top face. Further provided is a trough formed in the top face of the block of foam about an axis which resides perpendicular with respect to a central extent of one of the pairs of side faces. Next provided is a plurality of ellipsoidal protrusions formed in the top face of the block of foam.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
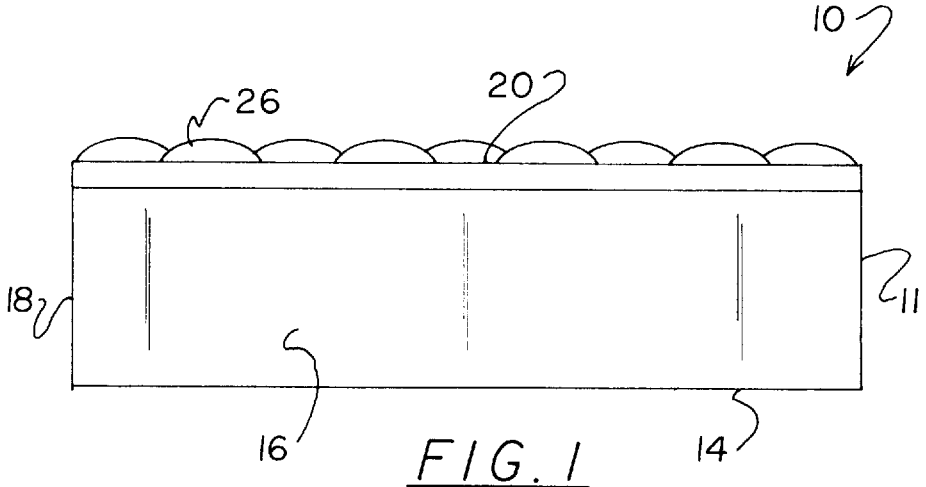
FIG. 1 is an illustration of the preferred embodiment of the extremity pillow constructed in accordance with the principles of the present invention.
Figure 2:
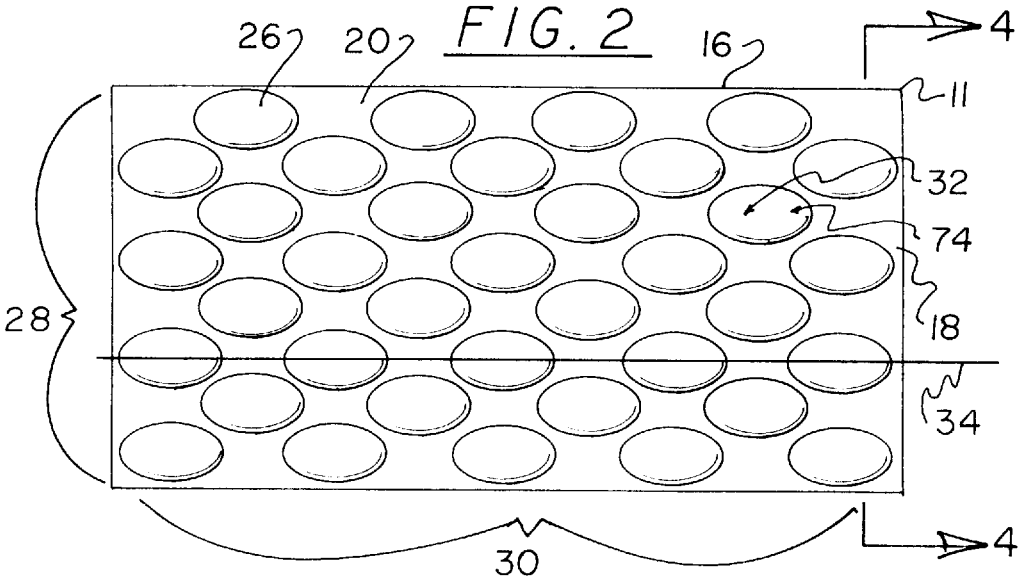
FIG. 2 is a top view of the present invention.

With reference now to the drawings, and in particular to FIG. 1 thereof, a new and improved extremity pillow embodying the principles and concepts of the present invention and generally designated by the reference numeral 10 will be described.

The present invention, the new and improved extremity pillow, is comprised of a plurality of components. Such components in their broadest context include a block of foam, a trough, and a plurality of ellipsoidal protrusions. Such components are individually configured and correlated with respect to each other so as to attain the desired objective.

More specifically, it will be noted that the system 10 of the present invention includes a block of urethane foam 12. Such block has a horizontally orientated bottom face 14, a pair of long vertically oriented side faces 16, a pair of short vertically oriented side faces 18, and a top face 20. Note FIGS. 1 & 3. The bottom face and long vertically oriented side faces are each planar and have a rectangular configuration. In the preferred embodiment, the block has a height of 5 inches, a length of 21 inches, and a width of 11.25 inches.

Figure 3:
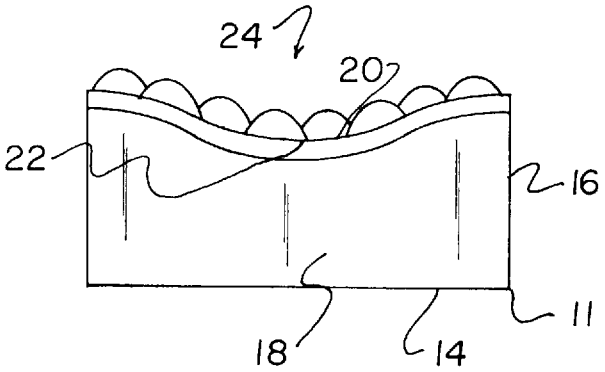
FIG. 3 is a side view of the present invention.
Figure 4:
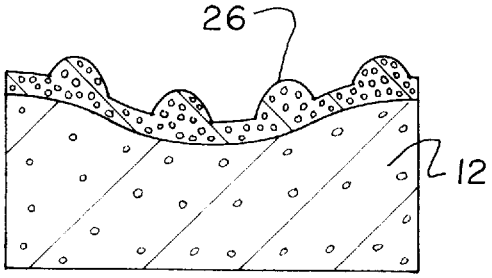
FIG. 4 is a cross-sectional view of the present invention taken along line 4–4 shown in FIG. 2.

As best shown in FIGS. 3 & 4, a curvilinear trough 22 is formed in the top face of the block of foam. Such trough is positioned about an axis which resides perpendicular with respect to a central extent of the short vertically oriented side faces. As such, an upper edge of the short vertically oriented side faces define a dip 24.

Next provided is a plurality of ellipsoidal protrusions 26 formed in the top face. Such protrusions defines a plurality of rows 28 and columns 30. Preferably, the top face has 4 rows and 4 columns. Such matrix of rows and columns of protrusions are configured such that a first focus 32 of the protrusions of each column are aligned with each other and further aligned with those of a first adjacent column. Each protrusion of a common column further has a second focus 34 aligned with that of the other protrusions of the column. Further, such second foci are aligned with those of a second adjacent column. It should be noted that the foci of the protrusions of each row define a line 34 which is parallel with the axis of the trough.

As an option, the block of foam may be formed of a plurality of layers having various densities.

The trough in combination with the protrusions and the specific configuration thereof serve to preclude the inadvertently removal of an extremity of a user therefrom.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by letters patent of the United States is as follows:

1. An extremity pillow comprising, in combination:

a block of urethane foam having a horizontally orientated bottom face, a pair of long vertically oriented side faces, a pair of short vertically oriented side faces, and a top face, the bottom face and long vertically oriented side faces each being planar and having a rectangular configuration;

a curvilinear trough formed in the top face of the block of foam about an axis which resides perpendicular with respect to a central extent of the short vertically oriented side faces; and a plurality of ellipsoidal protrusions formed in the top face and defining a plurality of rows and columns of protrusions such that a first focus of the protrusions of each column are aligned with each other and further aligned with those of a first adjacent column and a second focus of the protrusions of each column are aligned with each other and further aligned with those of a second adjacent column, wherein the foci of the protrusions of each row define a line which is parallel with the axis of the trough thereby precluding the inadvertently removal of an extremity of a user therefrom.

2. An extremity pillow comprising:

a block of foam having a bottom face, two pairs of side faces, and a top face;

a trough formed in the top face of the block of foam about an axis which resides perpendicular with respect to a central extent of one of the pairs of side faces; and a plurality of ellipsoidal protrusions formed in the top face of the block of foam;

wherein the plurality of ellipsoidal protrusions define a plurality of rows and columns;

wherein a first focus of the protrusions of each column are aligned with each other and further aligned with those of a first adjacent column and a second focus of the protrusions of each column are aligned with each other and further aligned with those of a second adjacent column.

3. An extremity pillow as set forth in claim 2 wherein the foam is urethane foam.

4. An extremity pillow comprising:

a block of foam having a bottom face, two pairs of side faces, and a top face; and a plurality of ellipsoidal protrusions formed in the top face of the block of foam;

wherein the plurality of ellipsoidal protrusions define a plurality of rows and columns;

wherein a first focus of the protrusions of each column are alianed with each other and further aligned with those of a first adjacent column and a second focus of the protrusions of each column are aligned with each other and further aligned with those of a second adjacent column.

5. An extremity pillow as set forth in claim 4 wherein the foci of the protrusions of each row define a line which is parallel with a common axis.

* * * * *